United States Patent [19]

Lohr

[11] 4,209,942

[45] Jul. 1, 1980

[54] REMOTE CONTROL CAR

[76] Inventor: Raymond J. Lohr, 5043 Sterrettania Rd., Erie, Pa. 16506

[21] Appl. No.: 910,510

[22] Filed: May 30, 1978

[51] Int. Cl.[2] ..... A63H 30/00

[52] U.S. Cl. ..... 46/253; 46/262; 46/206

[58] Field of Search ..... 46/253, 262, 210, 206

[56] References Cited

U.S. PATENT DOCUMENTS

| | | | |
|---|---|---|---|
| 2,244,528 | 6/1941 | Schur | 46/253 |
| 3,697,071 | 10/1972 | Anderson | 46/206 |
| 3,733,739 | 5/1973 | Terzian | 46/206 |

*Primary Examiner*—Houston S. Bell, Jr.
*Attorney, Agent, or Firm*—Charles L. Lovercheck

[57] ABSTRACT

A four wheel drive toy car having an elongated body with rounded ends and a diameter greater than the height of said elongated body so that the car will run equally well inverted. The wheels have convex outer sides so that the car will not rest on its side, and will cause the toy car to right itself when turned over, and rubber tires for good traction. A cord is connected to the electric motor driving the car and the car is steered by tugging on the electrical cord.

12 Claims, 5 Drawing Figures

REMOTE CONTROL CAR

GENERAL STATEMENT OF THE INVENTION

The four wheel drive toy car has wheels of greater diameter than the height of the car body so that the wheels extend beyond the body in every direction. The motor driving the wheels is of high power so that the car has a high speed and an immediate quick reverse. The outer surface of the wheel is curved or convexed so that the car will not rest on its side, but will always land on its wheels. The car is steered by tugging on the electrical cable. Steering any other way would be too slow at the speed the car travels. The car can be raced with another similar car indoors or outdoors. A simple economical driving mechanism is provided. The car drive may have a 6 to 1 ratio, for example.

REFERENCE TO PRIOR ART

The following U.S. Pat. Nos. show cars of various types, but none of them show a car such as disclosed herein: 1,333,216, 2,257,064, 2,064,309 1,868,313, 2,718,729.

The present invention is an improvement over my prior U.S. Pat. No. 2,064,309 issued on Feb. 14, 1936.

U.S. Pat. No. 2,718,729, shows a remotely controlled toy vehicle with a hand-held battery pack.

U.S. Pat. No. 1,868,313, shows a toy automobile that will operate either upright or inverted. It is driven by a spring motor.

None of the patents shows an electrically driven car with curved ends and flat top and bottom that will run either inverted or upright, and with convex wheels which will prevent the car from resting on its side. The toy car will always land on its tires. The car disclosed will climb over books and various obstructions and when the obstruction is too steep, the car will merely roll over and proceed in the opposite direction.

OBJECTS OF THE INVENTION

It is an object of the invention to provide an improved toy.

Another object of the invention is to provide a toy with fast, starting action of interest to children.

Another object of the invention is to provide a toy that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
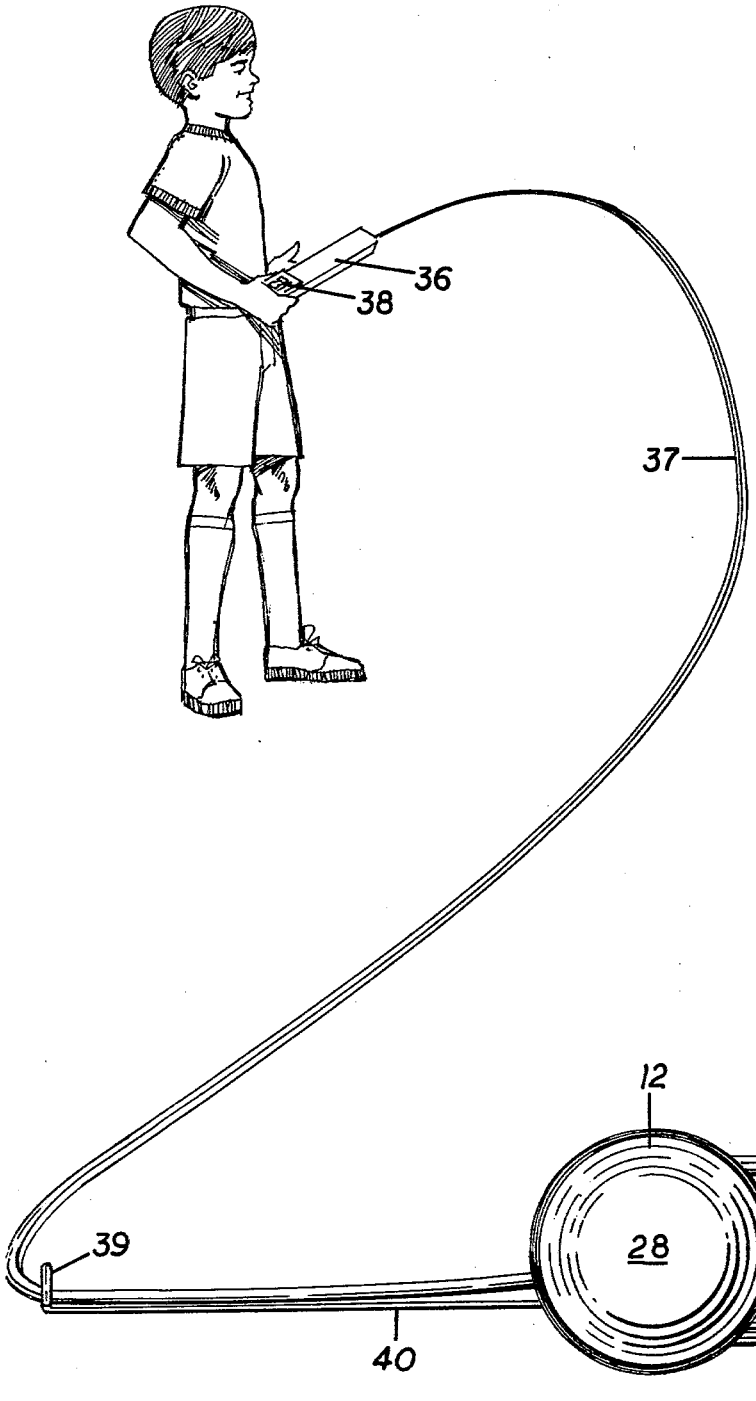
FIG. 1 is an end view of the car according to the invention.
Figure 1:
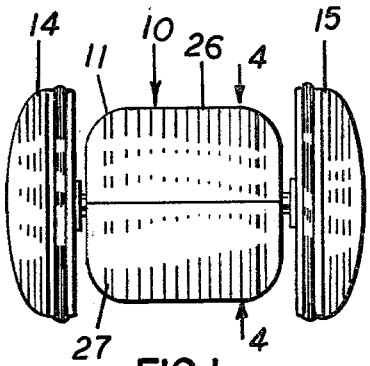
Figure 2:
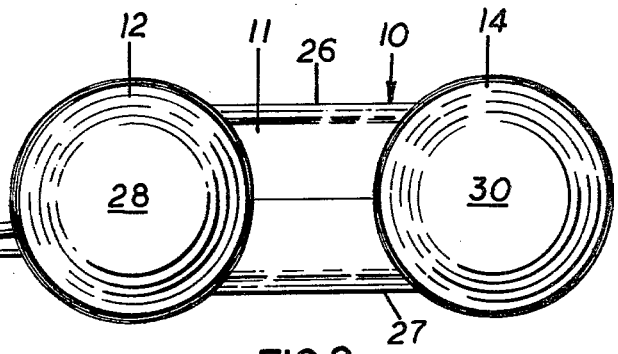
FIG. 2 is a side view of the car showing the control cables and the control box being held in position for use.
Figure 5:
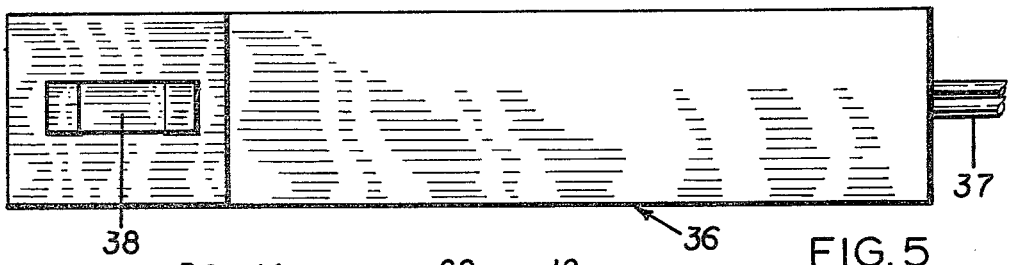
FIG. 5 is a top view of the control box.
Figure 3:
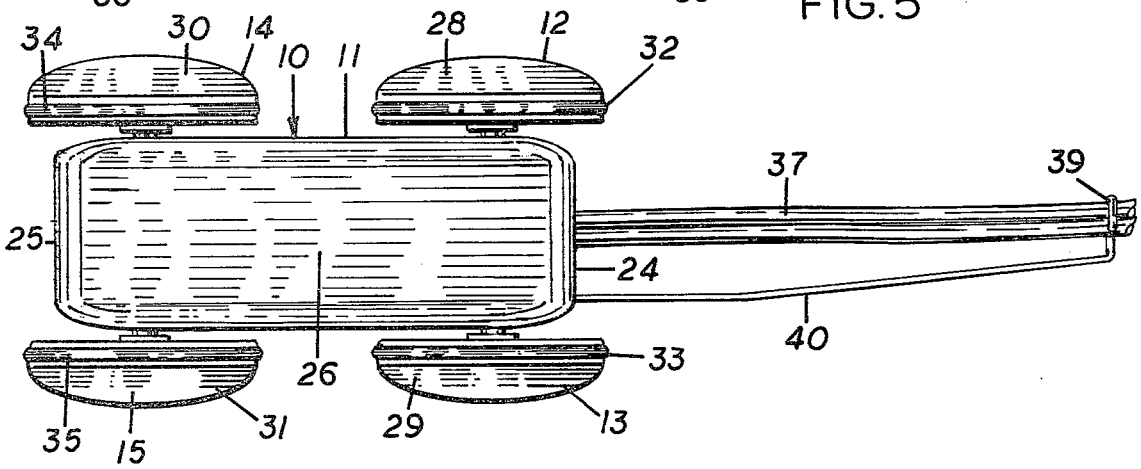
FIG. 3 is a top view of the car.
Figure 4:
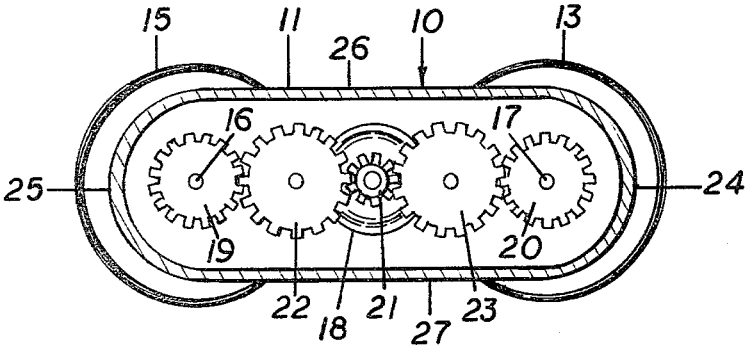
FIG. 4 is a cross-sectional view taken on line 4—4 of FIG. 1.

Now with more particular reference to the drawing. The car 10 as shown has a body 11 and four wheels 12, 13, 14 and 15. The front axle 16 is connected to the two front wheels and the rear axle 17 to the rear wheels. The body is provided with the curved ends 24 and 25 having a radius of curvature with the center on the axle 17 and 16 respectively. The motor 18 has a sprocket 21 that drives the gear idlers 22 and 23. Idler 22 engages the gear 19 on the front axle 16 while idler 23 drives the gear 20 on the rear axle 17.

The car has a flat top surface 26 and a flat bottom surface 27 and the wheels have convex outer surfaces 28, 29, 30 and 31 respectively and tires 32, 33, 34 and 35 respectively. The tires can be in the form of "O" rings supported in the groove on the outer periphery of the wheels or they can be of oval or rectangular cross section.

The control box 36 may contain batteries and is connected by a cable 37 to the motor 18. These batteries could be the common type of flashlight battery. The switch 38 may be a reversing switch for driving the car in reverse. Power is transmitted from the motor 18 to the wheels by a suitable gearing. Steering can be accomplished by tugging on the cable 37 which passes through eyelet 39 in the stiffener 40, which can be made of steel or rubber or flexible plastic.

The car is geared so that it has such high power that if it runs into an obstacle, the wheels running into it will climb up onto the obstacle or over it and may tip the car over backwards where it will again land on its wheels and run in the opposite direction. The wheels of the car allow it to run in the equally well inverted position and the convex outer surfaces of the wheels will roll the car back onto the tires whenever the car is tipped onto its side.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A car (10) having a body (11) and four wheels (12, 13, 14, 15),

- a front axle (16) and a rear axle (17) supporting said wheels on said body,
- a motor (18) on said body,
- a first gear (19) on said front axle and the second gear (20) on said rear axle,
- a sprocket (21) on said motor (18),
- a first idler gear (22) connected between said sprocket (21) and said first gear (19),
- a second idler (23) connected between said second gear (20) and said sprocket (21) whereby said wheels are driven in a first direction when said motor drives in a first direction and said wheels are driven in a second direction when said motor drives in a second direction.

2. The car recited in claim 1 wherein said body has a front end curved about the center of said axle and a rear end curved about the center perimeter of said rear axle and the wheels have a greater radius than the radius of said ends.

3. The car recited in claim 2 wherein each said wheel has a peripheral groove and a tire is supported in said peripheral groove of each said wheel.

4. The car recited in claim 3 wherin the outside surface of said wheels are convex whereby said car will not rest on its side but will tend to land on its tires.

5. The car recited in claim 1 wherein a battery pack is provided adapted to be hand-held by an operator.

a flexible electrical wire connecting said battery pack to said car, said car being adapted to be steered by said electrical wire.

6. The car recited in claim 1 wherein an elongated semi-stiff member is attached to the rear end of said body and extends rearwardly therefrom, means on the distal end of said member engaging said electrical cord for facilitating steering said car.

7. A car having a body, a motor on said body, front wheels and rear wheels attached to said body and supported thereon, said body having a top surface, a bottom surface, front and rear end surfaces, and side surfaces, said front and rear wheels extend above said top surface and below said bottom surface, said front wheels extend beyond said front end surface, and said rear wheels extend beyond said rear end surface, whereby said wheels will engage a supporting surface and carry said car in an upright or inverted position and said wheels will engage and climb obstacles encountered in forward or rearward motion of said vehicle.

8. The car recited in claim 7 wherein said front and rear wheels have a convex outer surface whereby said car when tipped on its side will tend to roll onto the wheels in either an upright or inverted position.

9. The car recited in claim 8 wherein an elongated, relatively rigid member is attached to the rear end of said body and extends rearwardly therefrom, means on the distal end of said relatively rigid member to engage an electric cord attached to said motor whereby said cord may be tugged to steer said car.

10. A car having a body, a motor on said body, mounted centrally thereon, front wheels and rear wheels attached to said body, said body having a top surface, a bottom surface, front and rear end surfaces and side surfaces, an elongated relatively rigid resilient member attached to the rear end of said body and extending rearwardly therefrom, an electric cord attached to the body and connected to said motor means on the distal end of said relatively rigid member engaging said electric cord, said cord being adapted to be manually pulled by an operator to steer said car.

11. The car recited in claim 10 wherein said front wheels and said rear wheels have convex outer surfaces whereby said car when tipped on its side will tend to roll onto the wheels in either an upright or inverted position.

12. The car recited in claim 11 wherein a front axle and a rear axle support said wheels on said body, a first gear on said front axle, a second gear on said rear axle, a sprocket on said motor, a first idle gear connected between said sprocket and said first gear, a second idle gear connected between said second gear and said sprocket, whereby said wheels are dirven in a first direction when said motor drive is in the first direction and said wheels are driven in a said second direction when said motor drives in said second direction.

* * * * *